US005822806A

United States Patent [19]

Kizhnerman

[11] Patent Number: 5,822,806

[45] Date of Patent: Oct. 20, 1998

[54] WALL MOUNTED WASTE RECEPTACLE

[76] Inventor: Samuil Kizhnerman, 19 Blythe Pl., Staten Island, N.Y. 10306

[21] Appl. No.: 826,568

[22] Filed: Apr. 4, 1997

[51] Int. Cl.[6] ..... E03D 13/00

[52] U.S. Cl. ..... 4/310; 4/302; 4/661

[58] Field of Search ..... 4/310, 311, 306, 4/304, 302, 213, 144.1, DIG. 3, DIG. 18, 655, 657, 658, 661

[56] References Cited

U.S. PATENT DOCUMENTS

| | | | |
|---|---|---|---|
| 465,566 | 12/1891 | Shepard | 4/311 |
| 704,471 | 9/1902 | Brown | 4/306 |
| 2,182,979 | 12/1939 | Bruzenak | 4/310 |
| 5,448,783 | 9/1995 | Ryan | 4/658 |
| 5,664,867 | 9/1997 | Martin et al. | 4/661 |

*Primary Examiner*—David J. Walczak

[57] ABSTRACT

A wall mounted waste receptacle including a housing having an enlarged opening extending into a hollow interior thereof mounted to a wall area at least four feet above a ground area. The hollow interior has an upper opening and a lower opening. The lower opening has a threaded pipe extending downwardly therefrom. A free end of the threaded pipe extends within an existing drain pipe. A water dispenser is coupled with the upper opening of the housing and with a water supply. The enlarged opening is dimensioned for a user's face to be placed therein for vomiting. The water dispenser will wash away the vomit.

6 Claims, 4 Drawing Sheets

WALL MOUNTED WASTE RECEPTACLE

BACKGROUND OF THE INVENTION

1. Field of the Invention

The present invention relates to a wall mounted waste receptacle and more particularly pertains to providing a convenient place for a person to vomit with a wall mounted waste receptacle.

2. Description of the Prior Art

The use of wall mounted urinal is known in the prior art. More specifically, wall mounted urinal heretofore devised and utilized for the purpose of receiving urinary waste are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,206,961 to Ruegg discloses a all-mounted urinal.

U.S. Pat. No. 5,398,348 to Tashiro et al. discloses a water urinal.

U.S. Pat. No. Des. 352,349 to Kergoet et al. discloses the ornamental design for a urinal.

U.S. Pat. No. 3,920,179 to Hall discloses a disposable vomiting bag.

U.S. Pat. No. 5,450,632 to Esswein et al. discloses a standing urinal.

U.S. Pat. No. Des. 258,682 discloses the ornamental design for a urinal.

While these devices fulfill their respective, particular objective and requirements, the aforementioned patents do not describe a wall mounted waste receptacle for providing a convenient place for a person to vomit.

In this respect, the wall mounted waste receptacle according to the present invention substantially departs from the conventional concepts and designs of the prior art, and in doing so provides an apparatus primarily developed for the purpose of providing a convenient place for a person to vomit.

Therefore, it can be appreciated that there exists a continuing need for new and improved wall mounted waste receptacle which can be used for providing a convenient place for a person to vomit. In this regard, the present invention substantially fulfills this need.

SUMMARY OF THE INVENTION

In the view of the foregoing disadvantages inherent in the known types of wall mounted urinal now present in the prior art, the present invention provides an improved wall mounted waste receptacle. As such, the general purpose of the present invention, which will be described subsequently in greater detail, is to provide a new and improved wall mounted waste receptacle and method which has all the advantages of the prior art and none of the disadvantages.

To attain this, the present invention essentially comprises a housing having a generally oval configuration including a rounded outer surface having an enlarged opening extending into a hollow interior of the housing. The enlarged opening has a rubber gasket removably coupled with a peripheral edge thereof. The housing has a planar generally rectangular shaped rear panel. The rear panel has apertures through four corners thereof for mounting to a wall area at least four feet above a ground area. A pair of handles are secured to the rear panel on opposing sides of the housing. The hollow interior has an upper opening and a lower opening. The lower opening has a threaded pipe extending downwardly therefrom. A free end of the threaded pipe extends within an existing drain pipe. A water dispenser is coupled with the upper opening of the housing. The water dispenser has a branched open lower end disposed within the housing. An upper portion of the water dispenser has an inner end coupled with a water supply. An outer end of the upper portion has an activation handle. A motion sensor is secured to the rear panel of the housing. The motion sensor has an outer end extending within the hollow interior of the housing. An inner end of the motion sensor has a wire for connection to a power supply. A light source is secured to the rear panel of the housing. The light source has an illuminating end extending within the hollow interior of the housing. The light source has wiring extending therefrom for coupling to the motion sensor and the power supply. A fan is disposed within a small housing. The small housing is secured to the rear panel of the housing. The small housing has an open outer end extending into the hollow interior of the housing. The open outer end has a vented cover thereover. The fan has wiring extending therefrom for coupling to the motion sensor and the power supply. A pair of mesh screens are secured to the rounded outer surface of the housing disposed above and below the enlarged opening therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wall mounted waste receptacle which has all the advantages of the prior art wall mounted urinal and none of the disadvantages.

It is another object of the present invention to provide a new and improved wall mounted waste receptacle which may be easily and efficiently manufactured and marketed.

It is a further object of the present invention to provide a new and improved wall mounted waste receptacle which is of durable and reliable construction.

An even further object of the present invention is to provide a new and improved wall mounted waste receptacle which is susceptible of a low cost of manufacture with regard to both materials and labor, and which accordingly is then susceptible of low prices of sale to the consuming public, thereby making such a wall mounted waste receptacle economically available to the buying public.

Even still another object of the present invention is to provide a new and improved wall mounted waste receptacle for providing a convenient place for a person to vomit.

Lastly, it is an object of the present invention to provide a new and improved wall mounted waste receptacle including a housing having an enlarged opening extending into a hollow interior thereof mounted to a wall area at least four feet above a ground area. The hollow interior has an upper opening and a lower opening. The lower opening has a threaded pipe extending downwardly therefrom. A free end of the threaded pipe extends within an existing drain pipe. A water dispenser is coupled with the upper opening of the housing and with a water supply. The enlarged opening is dimensioned for a user's face to be placed therein for vomiting. The water dispenser will wash away the vomit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
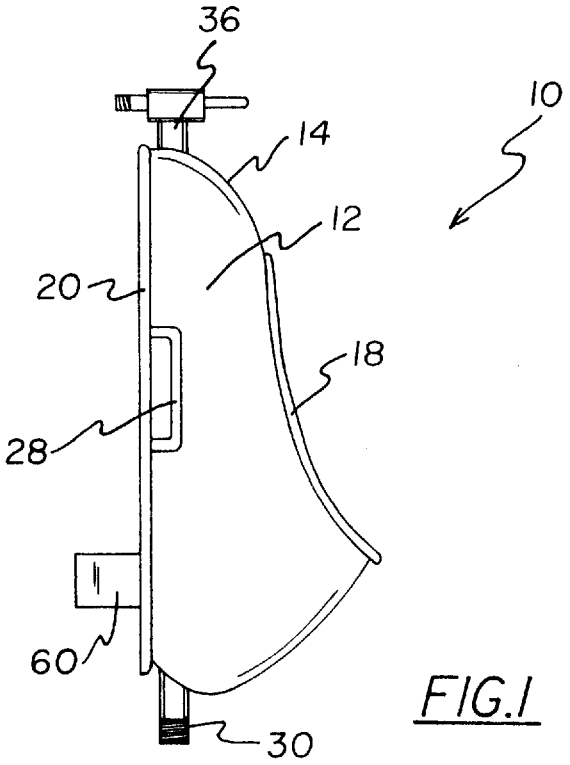
FIG. 1 is a side view of the preferred embodiment of the wall mounted waste receptacle constructed in accordance with the principles of the present invention.
Figure 2:
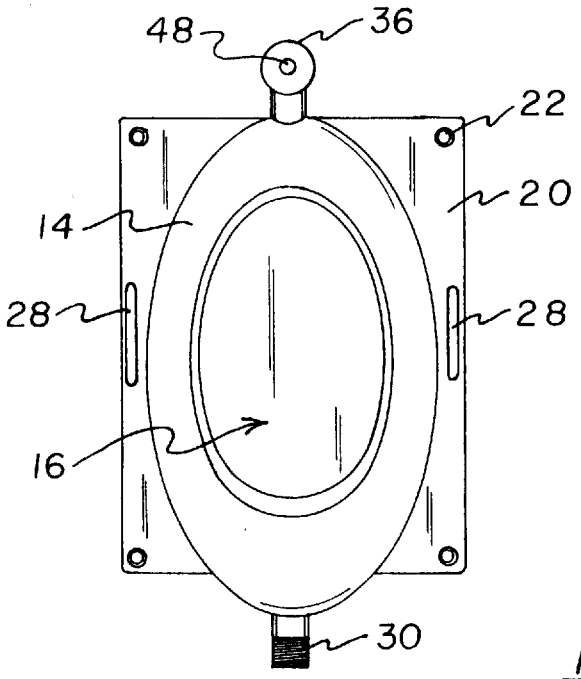
FIG. 2 is a front elevation view of the present invention.
Figure 3:
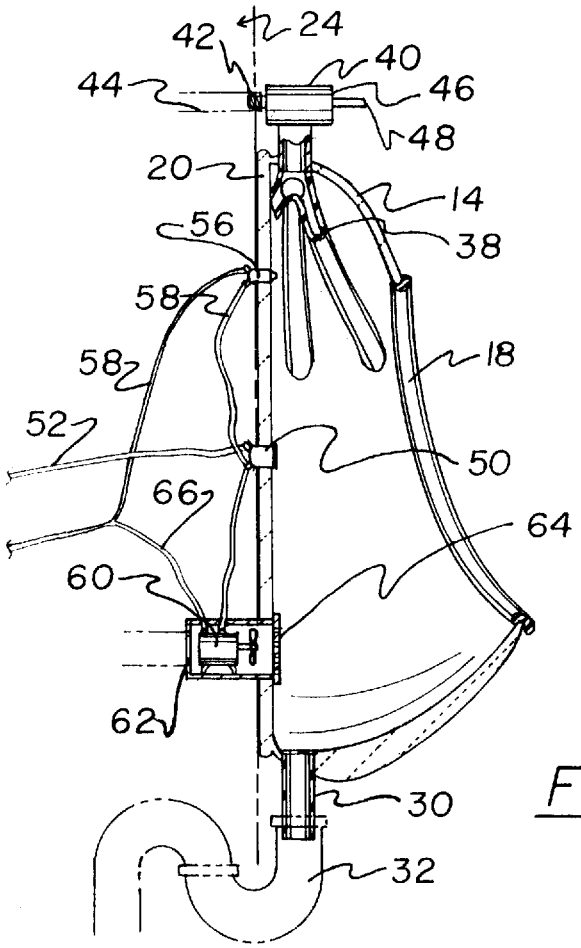
FIG. 3 is a cross-sectional view of the present invention as illustrated in FIGS. 1 and 2.
Figure 4:
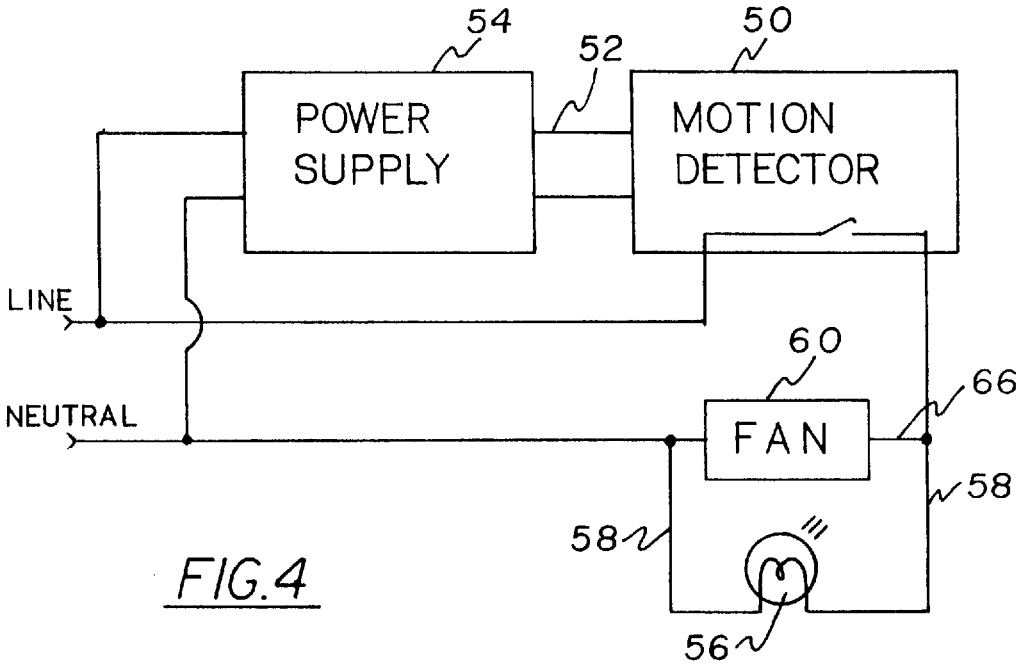
FIG. 4 is a schematic diagram of the function of the present invention.
Figure 5:
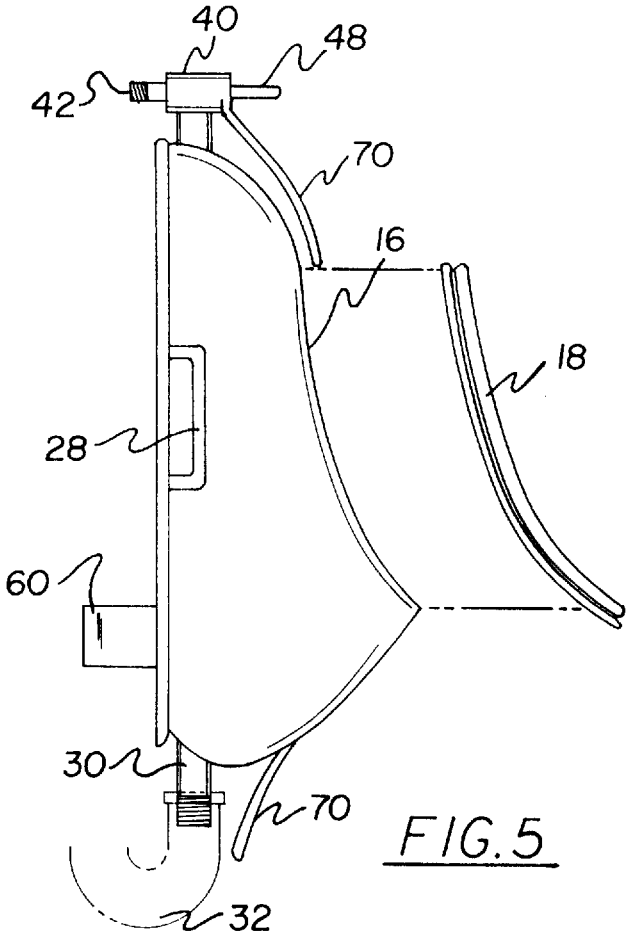
FIG. 5 is a side elevation view of the present invention illustrating the removable gasket.
Figure 6:
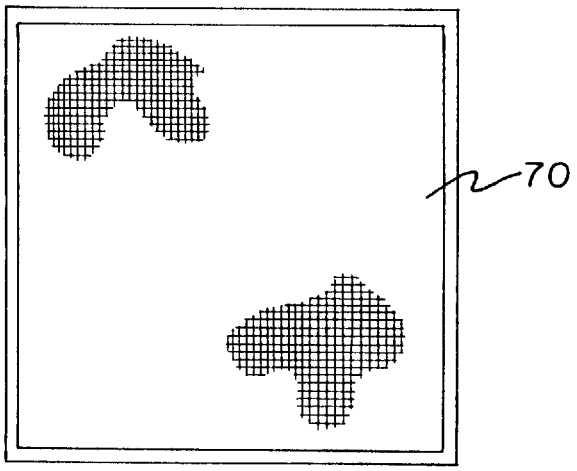
FIG. 6 is a front view of the optional mesh screen of the present invention.
Figure 7:
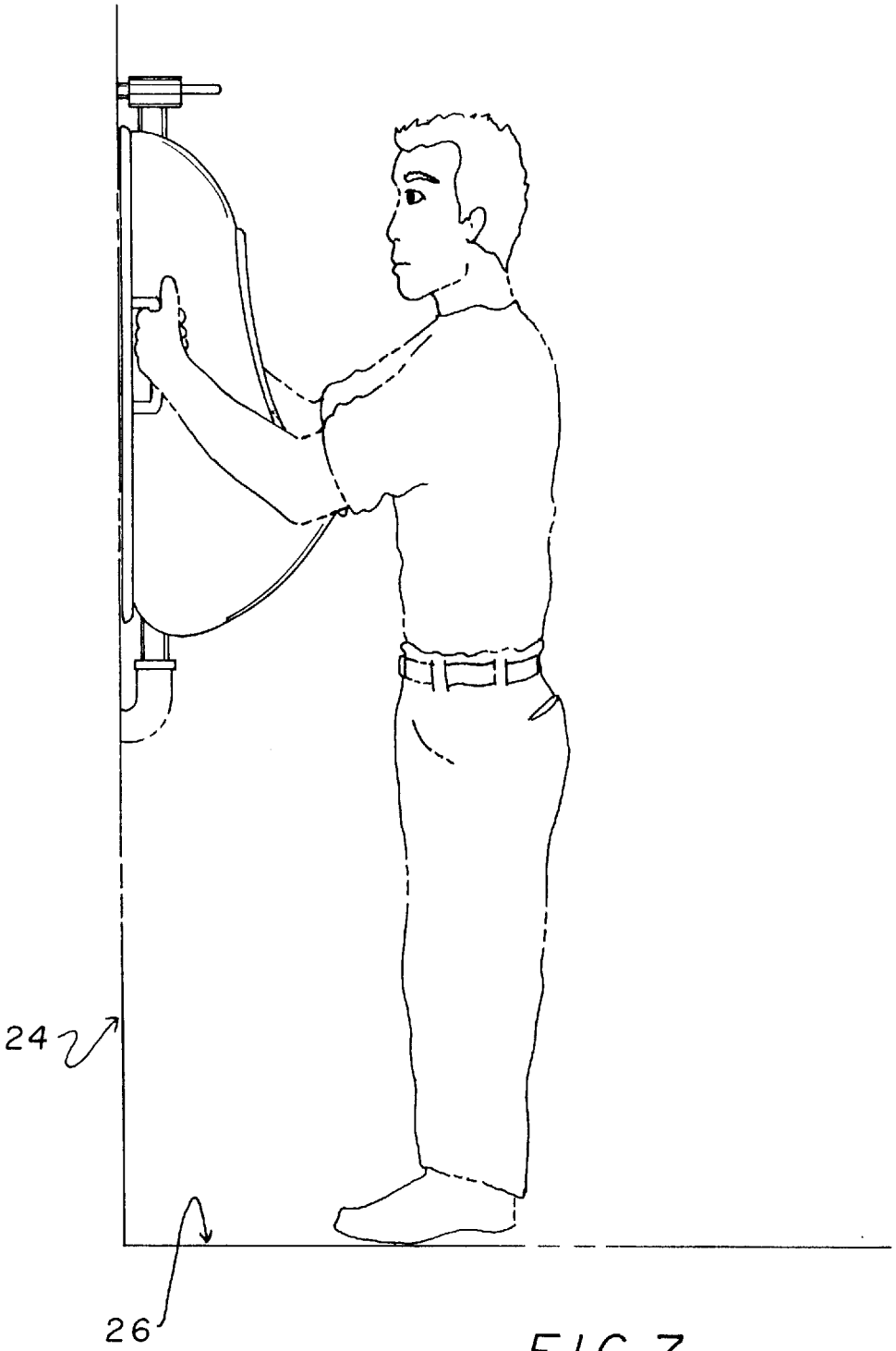
FIG. 7 is a side view of the present invention illustrated in use.

With reference now to the drawings, and in particular, to FIGS. 1 through 7 thereof, the preferred embodiment of the new and improved wall mounted waste receptacle embodying the principles and concepts of the present invention and generally designated by the reference number 10 will be described.

Specifically, it will be noted in the various Figures that the device relates to a wall mounted waste receptacle for providing a convenient place for a person to vomit. In its broadest context, the device consists of a housing, a water dispenser, a motion sensor, a light source, a fan and a pair of mesh screens. Such components are individually configured and correlated with respect to each other so as to attain the desired objective.

The device 10 includes a housing 12 having a generally oval configuration including a rounded outer surface 14 having an enlarged opening 16 extending into a hollow interior of the housing 12. The enlarged opening 16 has a rubber gasket 18 removably coupled with a peripheral edge thereof. The rubber gasket 18 can be easily removed and replaced on a regular basis for hygienic purposes. The housing 12 has a planar generally rectangular shaped rear panel 20. The rear panel 20 has apertures 22 through four corners thereof for mounting to a wall area 24 at least four feet above a ground area 26. The housing is positioned as such so as to allow a person to vomit from a more upright position. A pair of handles 28 are secured to the rear panel 20 on opposing sides of the housing 12. The pair of handles 28 provide a place for the user to grab onto to maintain balance. The hollow interior has an upper opening and a lower opening. The lower opening has a threaded pipe 30 extending downwardly therefrom. A free end of the threaded pipe 30 extends within an existing drain pipe 32.

A water dispenser 36 is coupled with the upper opening of the housing 12. The water dispenser 36 has a branched open lower end 38 disposed within the housing 12. An upper portion 40 of the water dispenser 36 has an inner end 42 coupled with a water supply 44. An outer end 46 of the upper portion 40 has an activation handle 48. After the user has finished vomiting, the activation handle 48 is manipulated to flush and dispose the vomit through the lower opening of the housing 12.

A motion sensor 50 is secured to the rear panel 20 of the housing 12. The motion sensor 50 has an outer end extending within the hollow interior of the housing 12. An inner end of the motion sensor has a wire 52 for connection to a power supply 54.

A light source 56 is secured to the rear panel 20 of the housing 12. The light source 56 has an illuminating end extending within the hollow interior of the housing 12. The light source 56 has wiring 58 extending therefrom for coupling to the motion sensor 50 and the power supply 54. The light source 56 is activated once the motion sensor reacts to the approaching user. This will aid the user in seeing the enlarged opening 16 and prevent any messy situations.

Associated with the motion sensor 50 and the light source 56 is a fan 60. The fan 60 is disposed within a small housing 62. The small housing 62 is secured to the rear panel 20 of the housing 12. The small housing 62 has an open outer end extending into the hollow interior of the housing 12. The open outer end has a vented cover 64 thereover. The fan 60 has wiring 66 extending therefrom for coupling to the motion sensor 50 and the power supply 54. As with the light source 56, once the motion sensor 50 reacts to the approaching user, the fan 60 will activate. The fan 60 serves to dissipate the unsavory odors associated with vomiting.

Lastly, a pair of mesh screens 70 are secured to the rounded outer surface 14 of the housing 12 disposed above and below the enlarged opening 16 therein. The mesh screens 70 serve as protective covers for the housing 12. The mesh screens 70 will be fabricated of a flexible plastic material that can be removed and replaced or cleaned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wall mounted waste receptacle for providing a convenient place for a person to vomit comprising, in combination:

a housing having a generally oval configuration including a rounded outer surface having an enlarged opening extending into a hollow interior of the housing, the enlarged opening having a rubber gasket removably coupled with a peripheral edge thereof, the housing having a planar generally rectangular shaped rear panel, the rear panel having apertures through four corners thereof for mounting to a wall area at least four feet above a ground area, a pair of handles secured to the rear panel on opposing sides of the housing, the hollow interior having an upper opening and a lower opening, the lower opening having a threaded pipe extending downwardly therefrom, a free end of the threaded pipe adapted to extend within an existing pipe;

a water dispenser coupled with the upper opening of the housing, the water dispenser having a branched open lower end disposed within the housing, an upper portion of the water dispenser having an inner end coupled with a water supply, an outer end of the upper portion having an activation handle;

a motion sensor secured to the rear panel of the housing, the motion sensor having an outer end extending within the hollow interior of the housing, an inner end of the motion sensor having a wire for connection to a power supply;

a light source secured to the rear panel of the housing, the light source having an illuminating end extending within the hollow interior of the housing, the light source having wiring extending therefrom for coupling to the motion sensor and the power supply;

a fan disposed within a small housing, the small housing secured to the rear panel of the housing, the small housing having an open outer end extending into the hollow interior of the housing, the open outer end having a vented cover thereover, the fan having wiring extending therefrom for coupling to the motion sensor and the power supply; and a pair of mesh screens secured to the rounded outer surface of the housing disposed above and below the enlarged opening therein.

2. A wall mounted waste receptacle for providing a convenient place for a person to vomit comprising, in combination:

a housing having an enlarged opening extending into a hollow interior thereof mounted to a wall area at least four feet above a ground area, the hollow interior having an upper opening and a lower opening, the lower opening having a threaded pipe extending downwardly therefrom, a free end of the threaded pipe adapted to extend within an existing pipe;

a water dispenser coupled with the upper opening of the housing and with a water supply and further including a pair of mesh screens secured to an outer surface of the housing disposed above and below the enlarged opening therein.

3. The waste receptacle as set forth in claim 2 and further including a motion activated light source secured within the housing.

4. The waste receptacle as set forth in claim 2 and further including a motion activated fan secured within the housing.

5. The waste receptacle as set forth in claim 2 wherein the enlarged opening of the housing having a rubber gasket removably coupled with a peripheral edge thereof.

6. The waste receptacle as set forth in claim 2 and further including a pair of handles secured on opposing sides of the housing.

* * * * *